US007641294B1

(12) United States Patent
Goldberg

(10) Patent No.: US 7,641,294 B1
(45) Date of Patent: Jan. 5, 2010

(54) SHOP DESK WITH HUTCH SIZED TO FIT WITHIN DESK BODY

(75) Inventor: Mark A. Goldberg, Lido Beach, NY (US)

(73) Assignee: Global Equipment Company Inc., Port Washington, NY (US)

( * ) Notice: Subject to any disclaimer, the term of this patent is extended or adjusted under 35 U.S.C. 154(b) by 0 days.

(21) Appl. No.: 11/360,228

(22) Filed: Feb. 23, 2006

(51) Int. Cl.
*A47B 17/00* (2006.01)

(52) U.S. Cl. ..... 312/196; 312/279

(58) Field of Classification Search ..... 312/178–279
See application file for complete search history.

(56) References Cited

U.S. PATENT DOCUMENTS 688,104 A * 12/1901 Lohrman ..... 312/196
D157,076 S * 1/1950 Nemes ..... D6/425
2,903,316 A * 9/1959 Schmidt ..... 312/196
4,870,630 A * 9/1989 Blake ..... 312/196
4,905,609 A * 3/1990 Haskins ..... 312/196

FOREIGN PATENT DOCUMENTS

JP 404005910 * 1/1992 ..... 312/196

* cited by examiner

*Primary Examiner*—Hanh V Tran
(74) *Attorney, Agent, or Firm*—Davidoff Malito & Hutcher LLP

(57) ABSTRACT

A shop desk with a desk body sized to define a volume bounded by a top, front, rear and side walls. A hutch is configured to fit within the volume when disassembled. The desk body is wider, longer and deeper than the hutch. The hutch secures to a top surface of the desk body when assembled. Legs support the desk body and a leg stabilizer platform connects to the legs at a location spaced from an underside of the desk body.

9 Claims, 9 Drawing Sheets

SHOP DESK WITH HUTCH SIZED TO FIT WITHIN DESK BODY

BACKGROUND OF THE INVENTION

Field of the Invention

The present invention relates to a shop desk with hutch. The hutch fits within a desk body in a disassembled condition.

Shop desks with hutches are packaged in a disassembled condition. However, the hutch is conventionally configured wider than the desk body and thus the shipping packaging container accommodates the hutch situated outside the desk body. As a result, shipping costs are higher than they would be without the hutch, because the overall volume to be accommodated is larger.

It would be desirable to conserve space within a packaging container so that the shop desk takes up no more room within the packaging container with a hutch accommodated than it would without the hutch.

SUMMARY OF THE INVENTION

The present invention relates to a packaged shop desk having a desk body whose confines is fitted with a hutch, the desk body with hutch being within a common packaging container.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
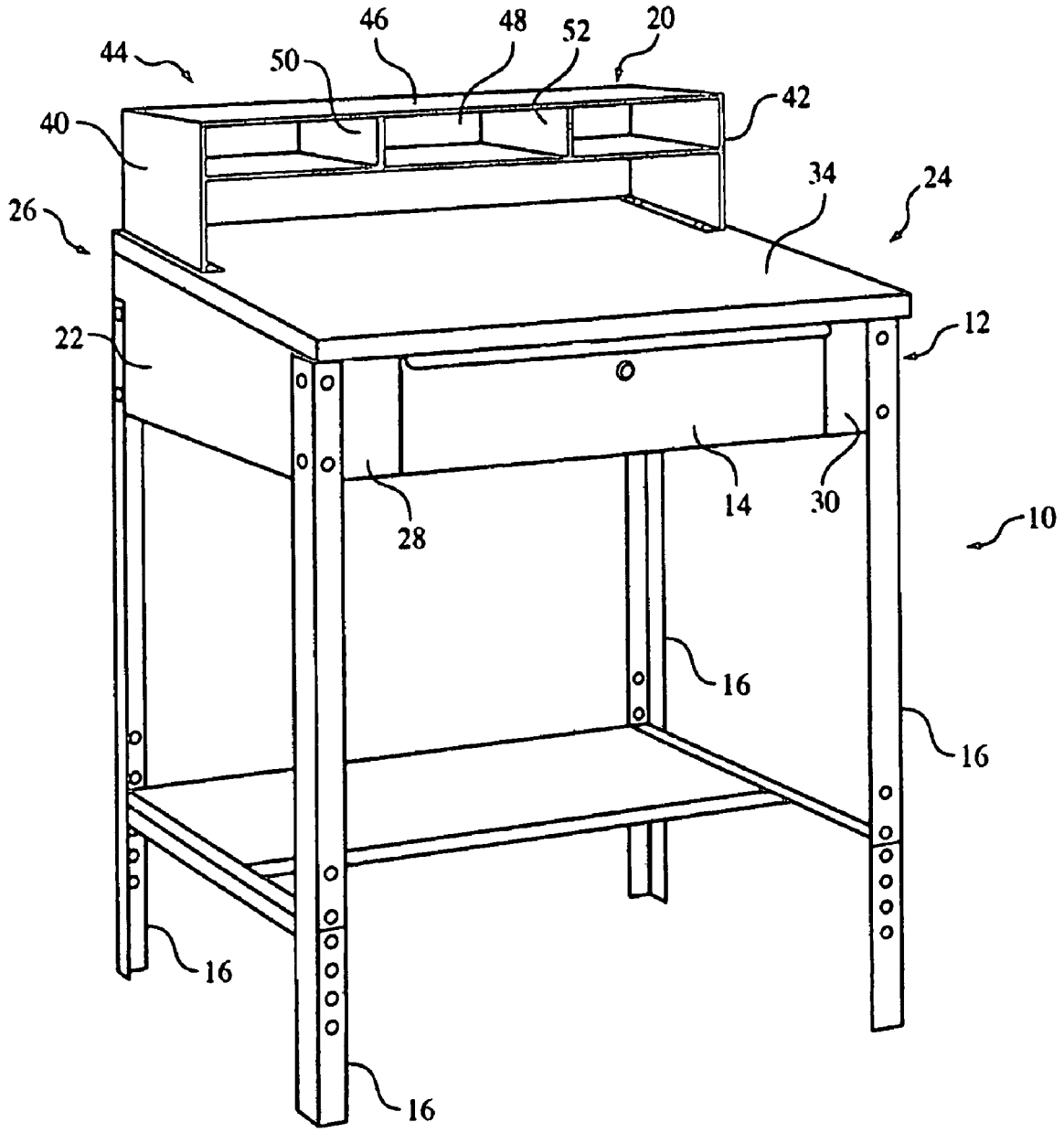
FIG. 1 shows a shop desk in assembled condition in accordance with the invention with a drawer in a closed position.
Figure 2:
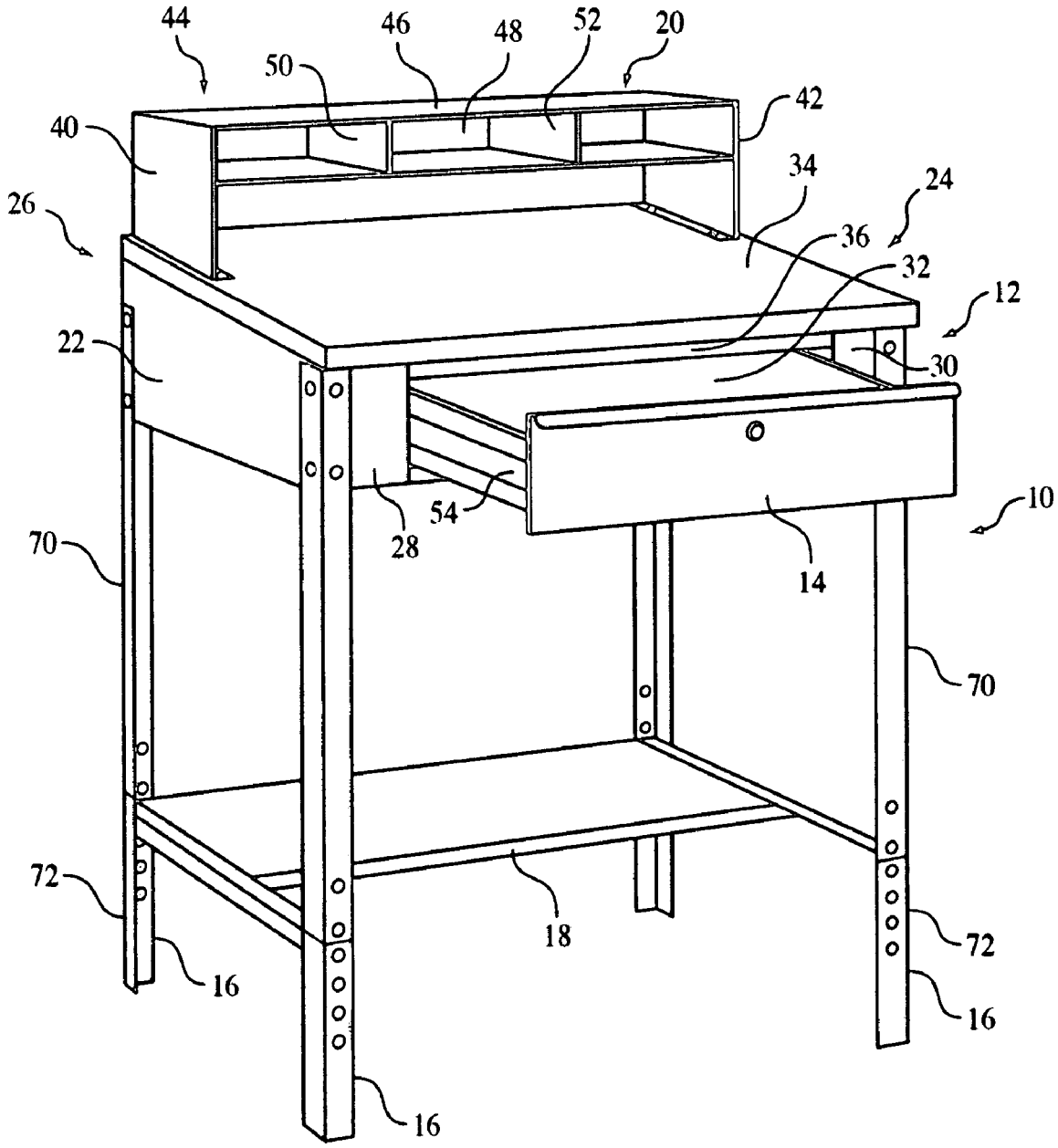
FIG. 2 shows the shop desk of FIG. 1 in assembled condition but with the drawer in an open position.

Turning to FIGS. 1 and 2, a shop desk 10 includes a desk body 12, a desk drawer 14 slidable between open and closed positions relative to the desk body 12, a plurality of leg assemblies 16, a leg stabilizer platform 18, and a hutch 20 secured to extend from the top of the rear of the desk body 12.

The hutch 20 is dimensional to fit within the desk body 12 when the shop desk is in a disassembled condition. Preferably, the desk body 12 is wider, deeper and longer. The desk body 12 includes two side panels 22, 24, a rear wall 26 extending between the two side walls 22, 24 and two front wall portions 28, 30 that extend from respective side walls 22, 24 sufficient to define an opening 32 for the desk drawer 14 to be accommodated for sliding movement between the closed and open positions (FIGS. 1 and 2). The desk body 12 also has a top 34 on the top edges of the side walls 22, 24, rear wall 26, and front wall portions 28, 30. The front wall portions 28, may be joined by a recessed strip 36 between them abutting beneath the top.

The hutch 20 includes opposite ends 40, 42 and an elongated rear wall 44 extending between the two opposite ends 40, 42 and an elongated top wall 46 likewise extending between the opposite ends 40, 42, but at right angles to the rear elongated wall 44.

An intermediate elongated wall 48 may be provided to extend between the opposite ends 40, 42 parallel to the top elongated wall 46 at a location intermediate of the two opposite ends 40, 42. Spaced apart vertical dividers 50, 52 may be provided between the top and intermediate elongated walls 46, 48. A conventional track 54 slides within a track support attached to the desk body 12. The desk drawer 14 slides in and out of the desk body 12 in a conventional manner using the track 54 and a counterpart on the appropriate side.

The leg stabilizer platform 18 is secured to the end of the leg assemblies 16 during assembly to stabilize the legs at locations spaced from the desk body 12. Preferably, the leg stabilizer platform 18 is parallel to the bottom and top of the desk body 12 to enable storage of items on the platform part, which is recessed from the front of the shop desk.

When shipping the disassembled shop desk in the packaging container, the hutch 20 is placed within confines of a volume defined by the desk body 12. To assemble, flanges at the bottom of the opposite ends 40, 42 of the hutch 20 that have spaced apart holes are positioned to align the holes with spaced holes in the top 34 to enable fasteners to secure the hutch 20 and desk body 12 together via the aligned holes. If the top 34 inclines, the flanges of the hutch 20 should likewise incline to match the angle of inclination.

Since the hutch 20 fits or is accommodated completely within confines of a volume defined by the desk body 12, that is, the volume bounded by the top 34, side walls 22, 24 rear wall 26 and front wall portions 28, 30 and strip 36, it takes up no more space beyond that of a volume defined by the confines of the desk body 12 within a packaging container than if the hutch 20 were omitted.

Figure 3:
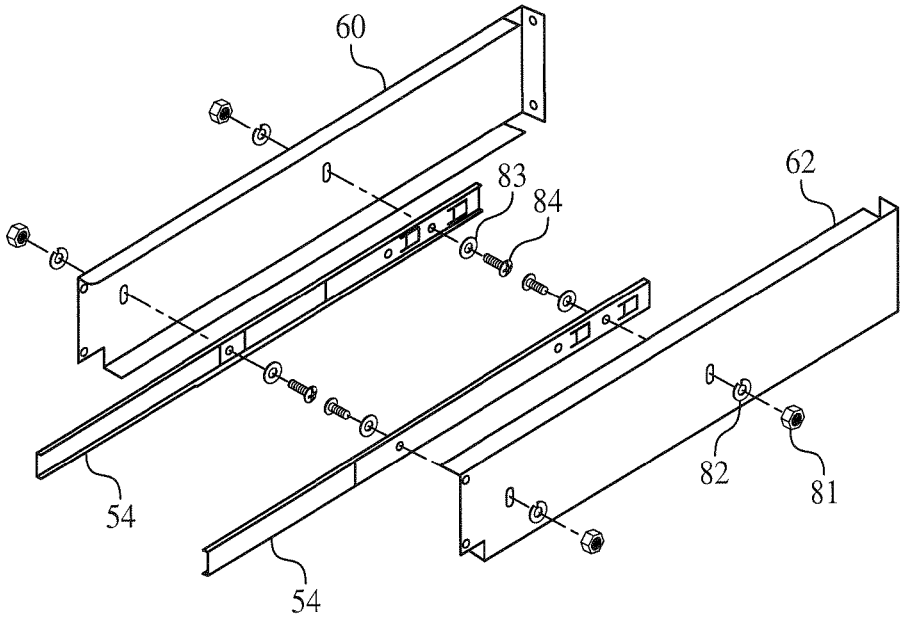
FIG. 3 shows an exploded view illustrating assembly of the sliding mechanism to a drawer.
Figure 9:
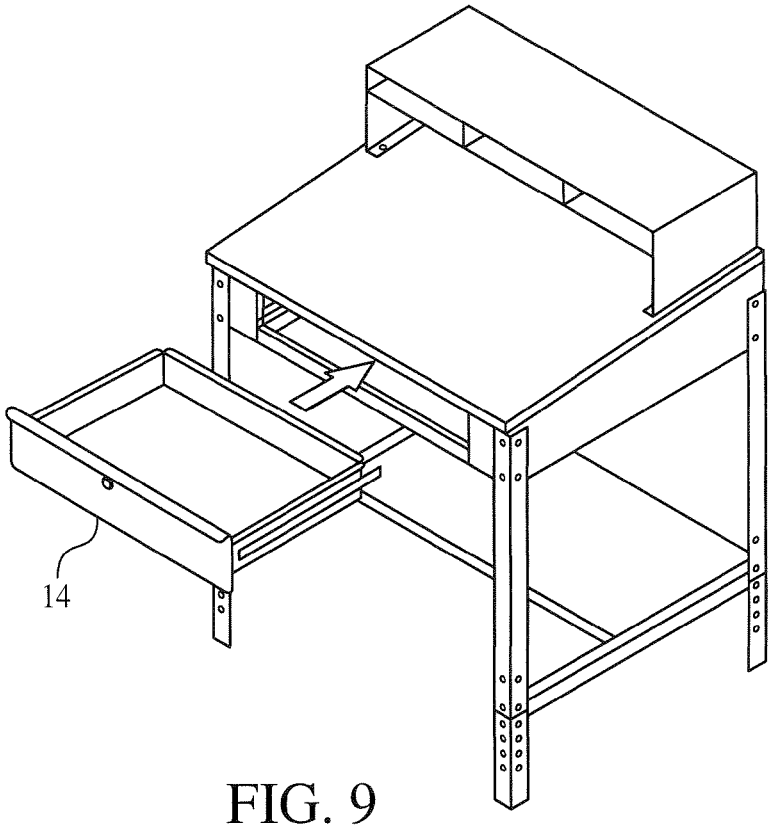
FIG. 9 shows an exploded view illustrating insertion of the drawer assembly of FIG. 3 into the assembly of FIG. 8.
Figure 10:
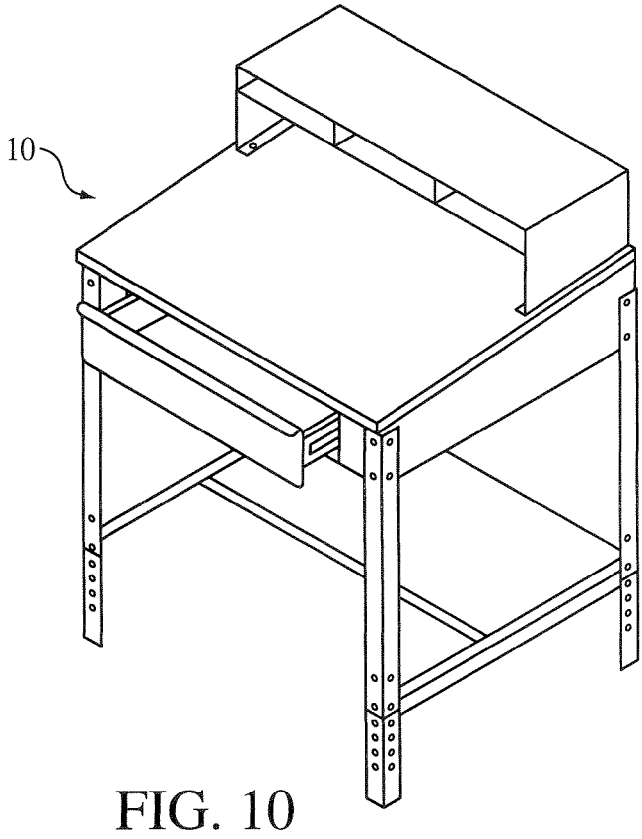
FIG. 10 shows an isometric view of the assembled shop desk of FIG. 9.
Figure 11:
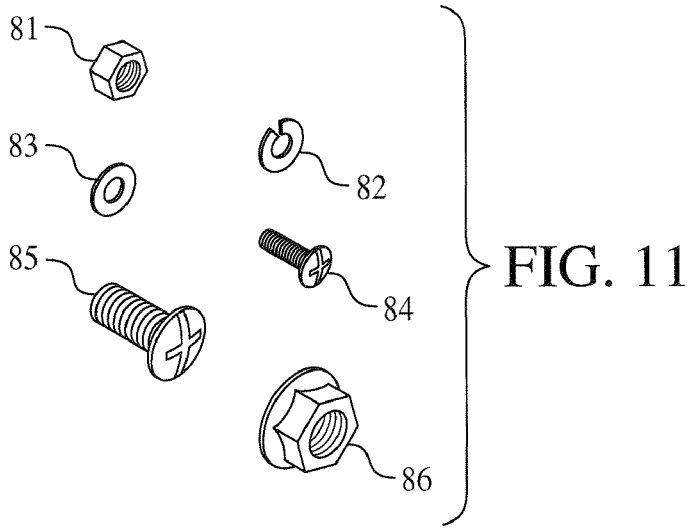
FIG. 11 shows fasteners used for the assembly of FIGS. 3-8.

FIGS. 3-11 illustrate how to assemble the shop desk. FIG. 3 shows a right side track support 60 and a left side track support 62 that are secured to a respective right track 64 and left track 54 by fasteners. As seen in FIG. 11, fasteners such as hex nuts 81, split washers 82, washers 83 and threaded screws 84 may be used as illustrated in FIG. 3. Pre-drilled holes are provided in the track supports 60, 62 and tracks 64, 54 to align in appropriate relative position to allow securement by the fasteners.

Figure 4:
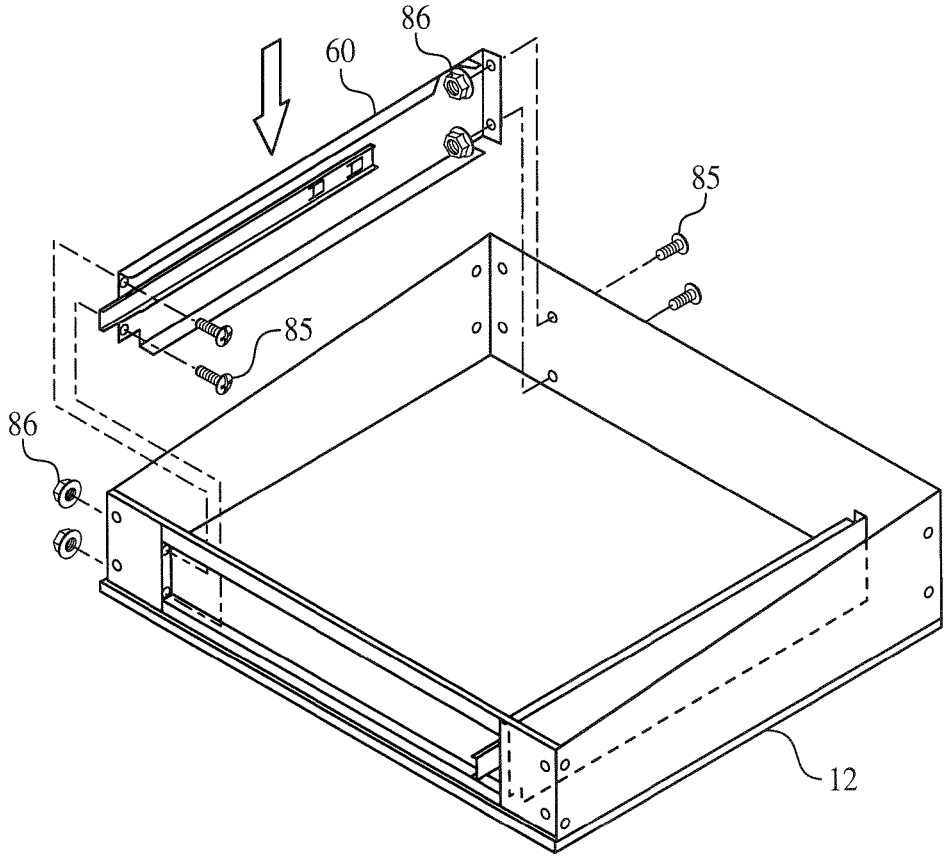
FIG. 4 shows an exploded view illustrating assembly of track supports to the desk body.
Figure 5:
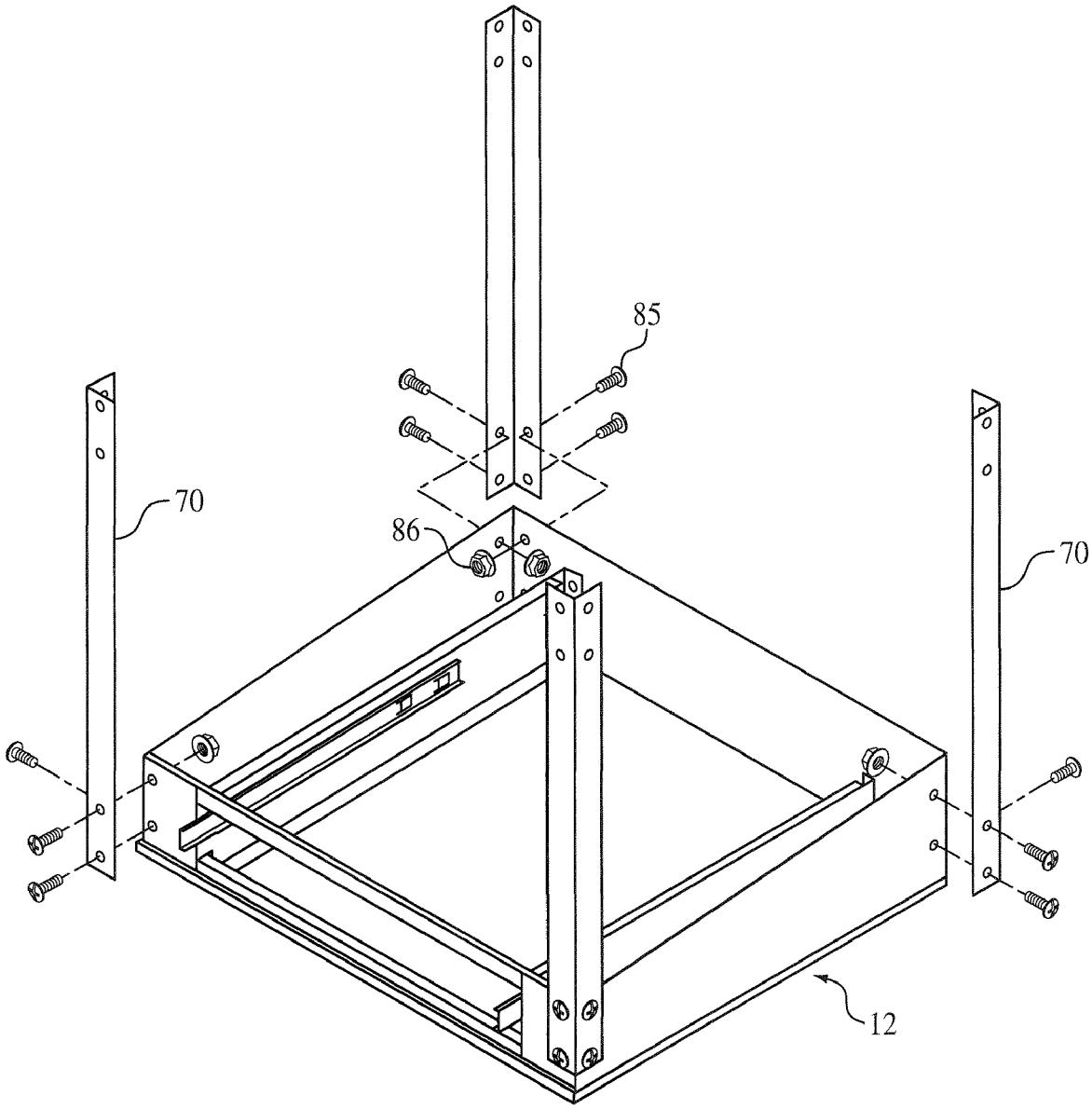
FIG. 5 shows an exploded view illustrating assembly of legs to the assembly of FIG. 4.

Turning to FIG. 4, desk body 12 is upside down and secured to the assembled right and left track supports of FIG. 2 with fasteners such as hex screws 85 and hex nuts 86 (see FIG. 11) as shown in FIG. 5. Again, pre-drilled holes are provided in the track supports 60, 62 and desk body 12 that align in the proper position to secure via the fasteners.

Turning to FIG. 5, the assembled desk body 12 of FIG. 4 is secured to ends of four legs 70 with hex screws 85 and hex nuts 86, as shown at respective outside corners of the underside of the desk top 5. Pre-drilled holes are provided in the legs and desk body 12 to align in their proper position to secure to each other via the fasteners.

Figure 6:
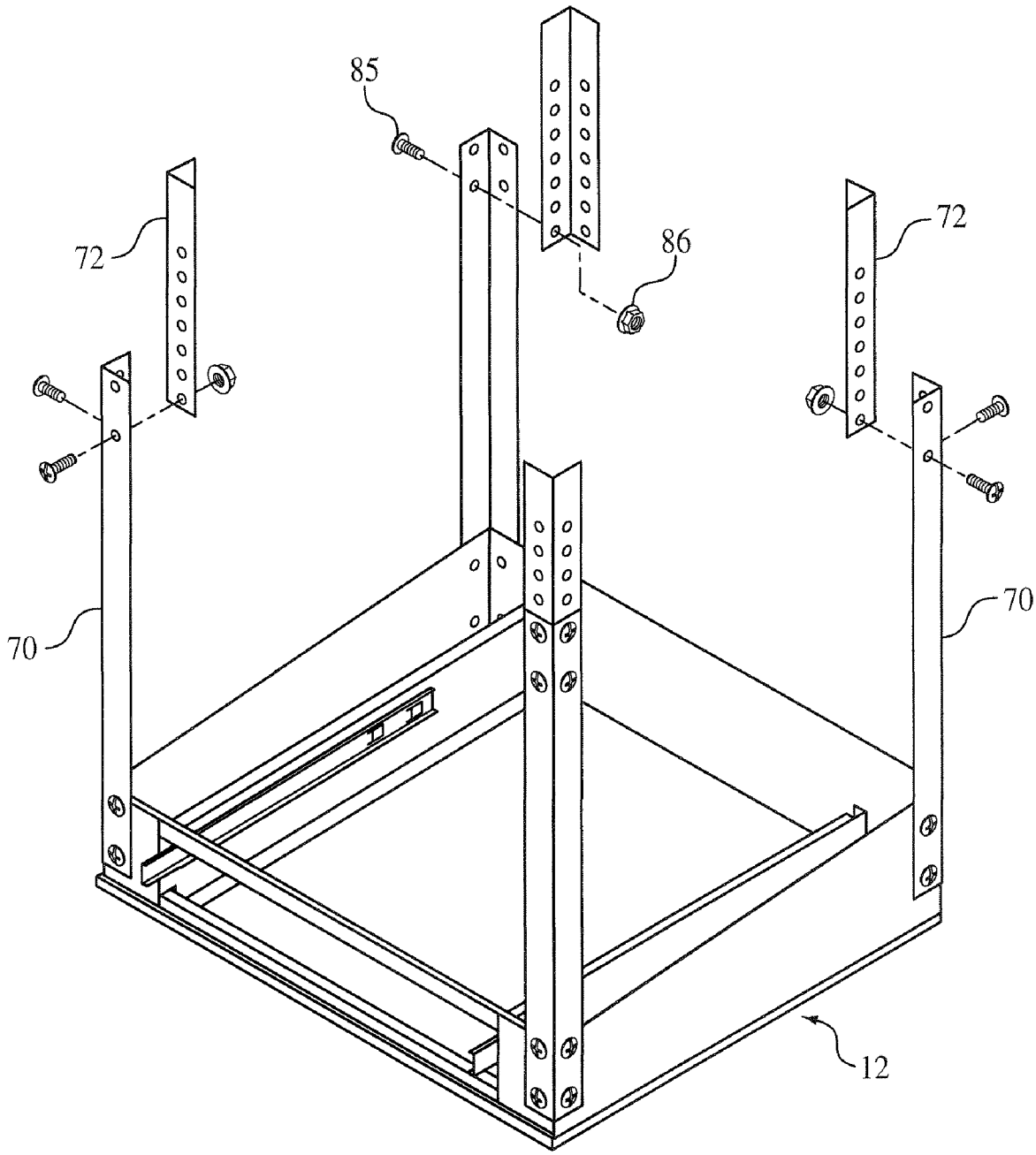
FIG. 6 shows an exploded view illustrating assembly of leg extensions to the legs of FIG. 5.

Turning to FIG. 6, leg extensions 72 are secured to the free ends of the four legs 70 using hex screws 85 and hex nuts 86. Pre-drilled holes are provided in the leg extensions 72 and legs 70 that align with each other for securement via fasteners in desired relative positions to form the leg assemblies 16.

Figure 7:
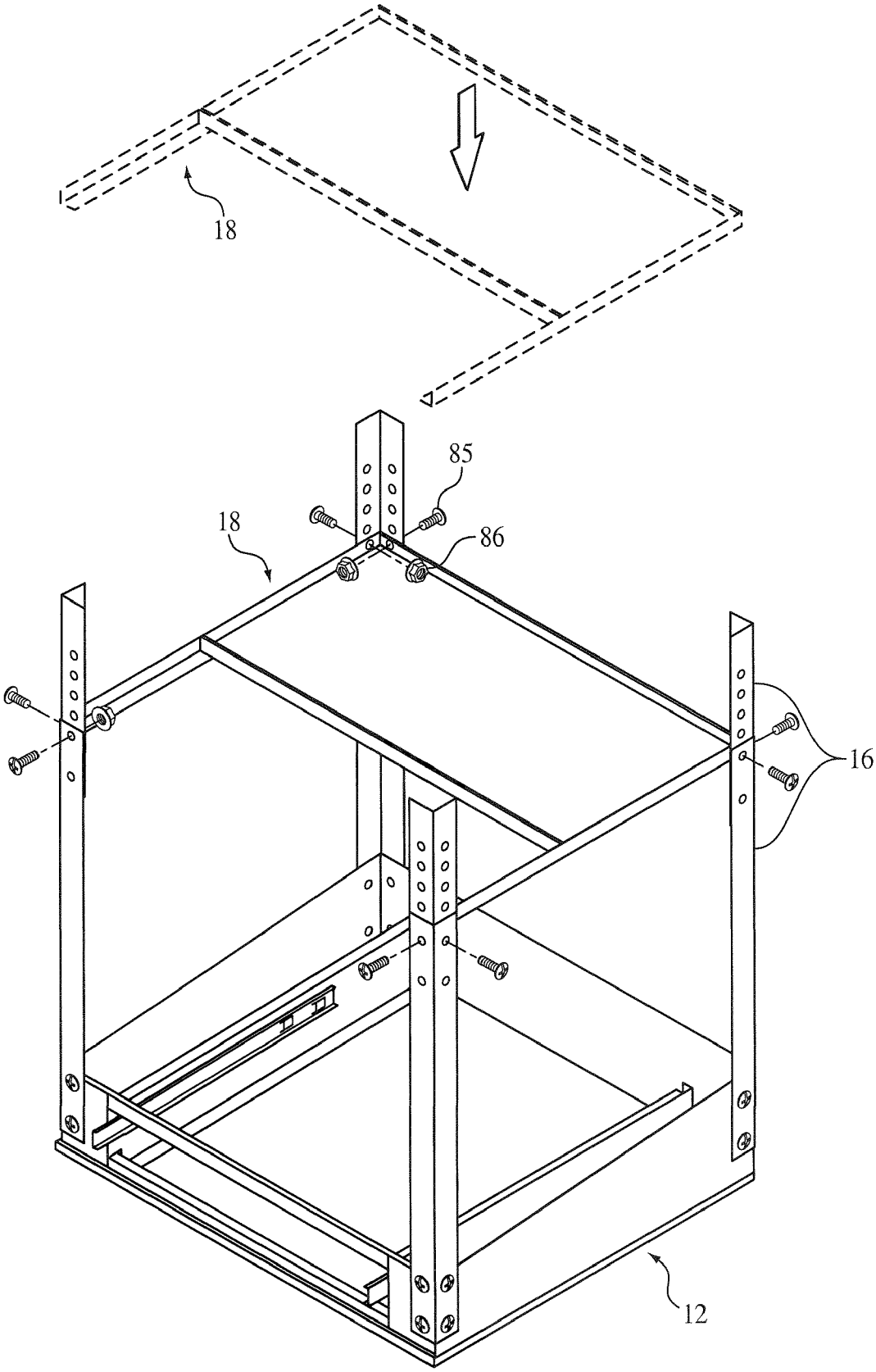
FIG. 7 shows an exploded view illustrating assembly of a leg stabilizer platform to leg assemblies of FIG. 6.

FIG. 7 shows assembly of the leg stabilizer platform 18 (or lower support shelf) to each of the leg assemblies 16, as shown after the FIG. 6 assembly is complete via fasteners such as the hex screws 85 and hex nuts 86. Pre-drilled holes are provided in the leg stabilizer platform 18 and leg assemblies 16 to accommodate the fasteners when the respective holes are aligned.

Figure 8:
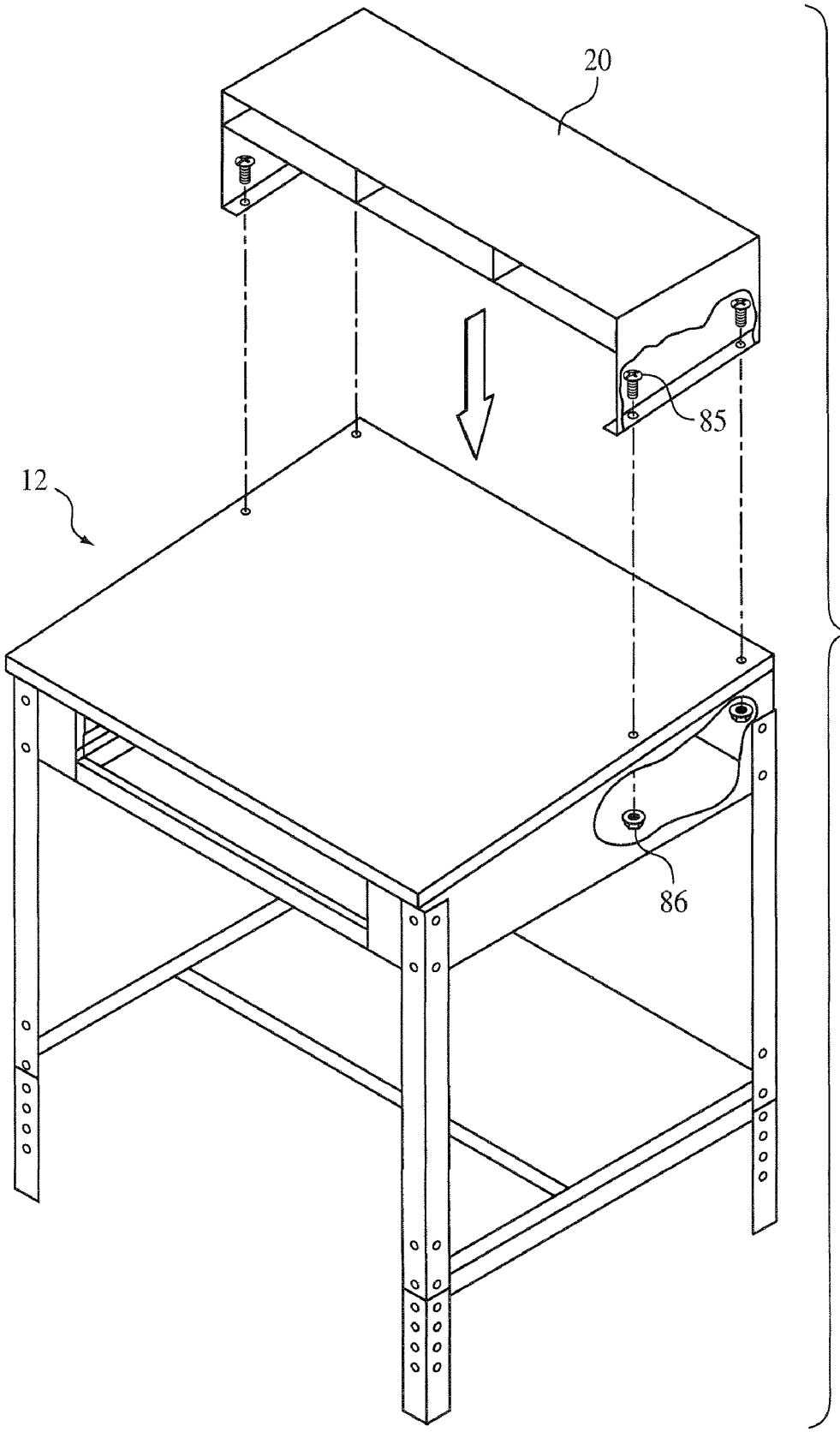
FIG. 8 shows an exploded view illustrating assembly of a hutch to the assembly of FIG. 7.

FIG. 8 shows assembly of the hutch 20 to the desk body 12 after the FIG. 7 assembly is complete and the shop desk is turned upright. The hutch 20 may also be considered a pigeon hole organizer. Hex screws 85 and hex nuts 86 may be used to secure the hutch 20 to the top of the desk body 12 via pre-drilled holes in each of the hutch 20 and the desk body 12 that align with each other.

FIG. 9 shows that the drawer 14 is inserted between the tracks 54, 64 of FIG. 4 to fit within the assembled shop desk of FIG. 9.

FIG. 10 shows the assembled shop desk 10.

The disassembled condition for packaging prior to assembly generally necessitates the desk body 12 to be upside down in the manner of FIG. 4. The remaining components, including the hutch 20, fits with confines of a volume defined by the interior of the desk body 12 in its upside down orientation. Such facilitates packaging the shop desk in a manner that minimizes packaging volume.

To package the shop desk into a packaging container, the following sequence may be used:

Place the desk body upside down in a top open box.

Figure 12:
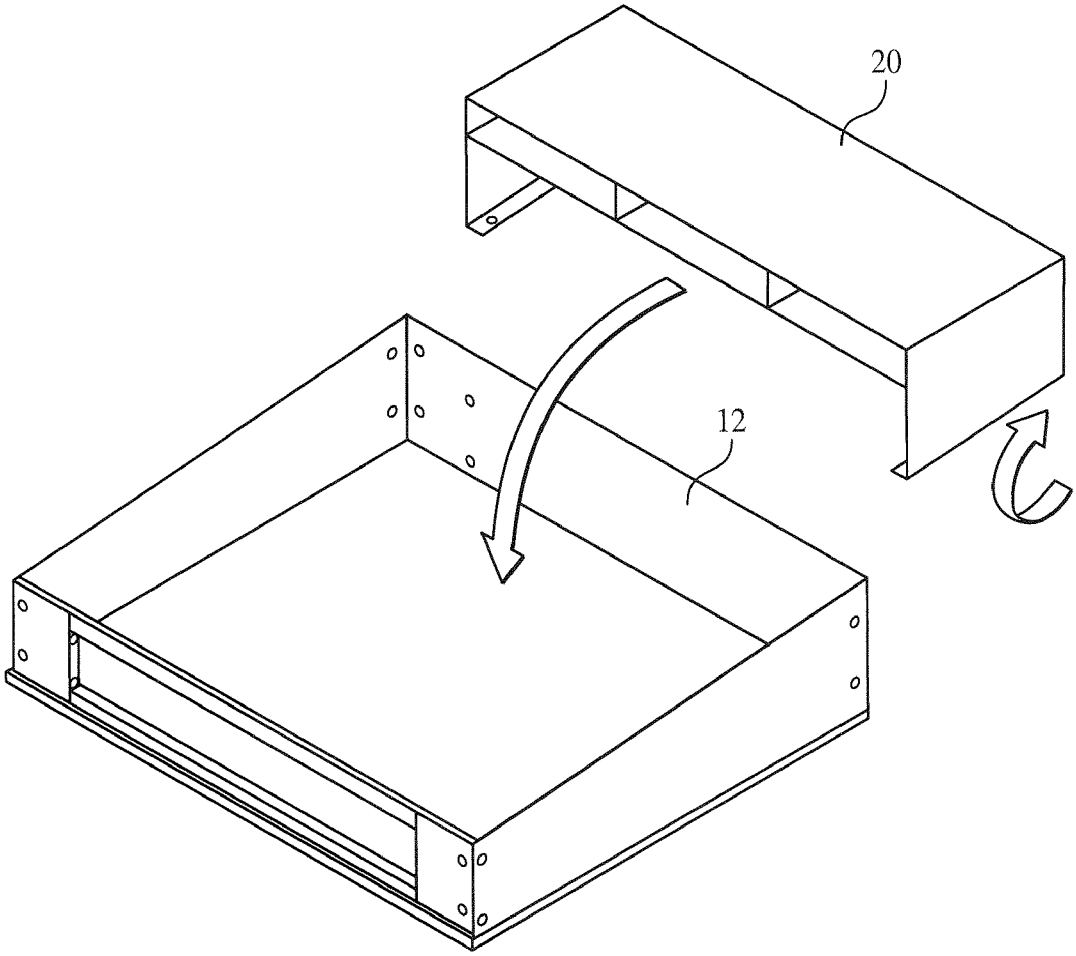
FIG. 12 shows an isometric view illustrating a manner of inserting the hutch into confines of the upside down desk body for packaging purposes.

Insert the hutch so that its rear wall is adjacent the rear of the desk body. Referring to FIG. 12, the hutch 10 is flipped 900 from the orientation shown as indicated by the turning arrow and laid down within confines of the desk body 12.

Insert the drawer 14, generally near where it is to fit (by the drawer opening) within the confines of the interior volume of the desk body.

Box the leg assemblies 16, sliding mechanism (tracks 54, 64 and track supports 60,62) and fastener hardware (81-86) together and insert the boxed group between the hutch 20 and the drawer 14 within the confines of the interior volume of the desk body.

Lay the leg stabilizer platform 18 on top of the components within the desk body.

Cardboard pieces may be inserted to cushion drawer components that would otherwise touch each other within the package so as to avoid scratches from arising due to jostling during shipment.

While the foregoing description and drawings represent the preferred embodiments of the present invention, it will be understood that various changes and modifications may be made without departing from the scope of the present invention.

What is claimed is:

1. A shop desk configured to minimize an amount of packaging space needed for shipping said shop desk in a disassembled condition, comprising:

a desk body having a top, opposite sidewalls, a front and a rear, said desk body defining a spatial volume bounded by an underside of said top, inner facing surfaces of said opposite sidewalls, an inner facing surface of said front, an inner facing surface of the said rear, and a plane defined by the bottom edges of said sidewalls, rear and front; and a hutch dimensioned in its entirety to fit as a fully assembled unit within confines of said spatial volume while disassembled from said desk body, and when said hutch is assembled with said desk body, in an upright position, said desk body is wider and longer than the said hutch, and said hutch having an upright dimension in said upright position that is smaller than an upright dimension of each of said sidewalls in their upright positions.

2. The shop desk of claim 1, further comprising a plurality of leg assemblies dimensioned in their entireties to fit within confines of said spatial volume as well while disassembled from said desk body, said leg assemblies being assembled to support said desk body in an upright position and a leg stabilizer platform that is dimensioned in its entirety to fit within the confines of said spatial volume as well while disassembled from said leg assemblies and is assembled to secure to said plurality of leg assemblies.

3. The shop desk of claim 1, further comprising a sliding mechanism dimensioned in its entirety to fit within confines of said spatial volume as well while disassembled from said desk body and being assembled to attach to said desk body; and a desk drawer dimensioned in its entirety to fit within confines of said spatial volume as well while disassembled from said sliding mechanism and being assembled to attach to said sliding mechanism, said sliding mechanism being configured to enable said desk drawer to slide in and out through the front relative to said desk body.

4. The shop desk of claim 1, wherein said hutch includes opposite ends and top, intermediate and rear walls extending between said opposite ends with dividers spaced apart from each other between said top wall and said intermediate wall.

5. The shop desk of claim 3, wherein said desk body is in an upright, self-standing condition and being free of a bottom.

6. A disassembled shop desk configured to minimize an amount of packaging space needed for shipping said shop desk in a disassembled condition, comprising:

a desk body having a top, opposite sidewalls, a front and a rear, said desk body defining a spatial volume bounded by an underside of said top, inner facing surfaces of opposite sidewalls, an inner facing surface of said front, an inner facing surface of said rear and a plane defined by the bottom edges of said sidewalls, rear and front; and a hutch as a fully assembled unit fitting entirely within confines of said spatial volume, said hutch being dimensioned to fit on said desk body in an upright position after assembly such that said desk body is both wider and longer than said hutch, said hutch having an upright dimension in said upright position that is smaller than an upright dimension of each of said sidewalls as the fully assembled unit.

7. The disassembled shop desk of claim 6, wherein said hutch includes opposite ends and top, intermediate and rear walls extending between said opposite ends with dividers spaced apart from each other between the top wall and said intermediate wall.

8. The disassembled shop desk of claim 6, further comprising leg assemblies, a leg stabilizer platform, and a drawer all in their entireties fitting within said confines of said spatial volume of said shop desk.

9. The disassembled shop desk of claim 8, further comprising tracks of a sliding mechanism and hardware fitting within said confines of said spatial volume of said shop desk.

* * * * *